United States Patent [19]

Terauchi

[11] 4,304,535

[45] Dec. 8, 1981

[54] SCROLL-TYPE COMPRESSOR UNITS WITH MINIMUM HOUSING AND SCROLL PLATE RADII

[75] Inventor: Kiyoshi Terauchi, Isesaki, Japan

[73] Assignee: Sankyo Electric Company Limited, Isesaki, Japan

[21] Appl. No.: 81,392

[22] Filed: Oct. 3, 1979

[30] Foreign Application Priority Data

Oct. 12, 1978 [JP] Japan ..... 53-125898

[51] Int. Cl.[3] ..... F04C 18/02

[52] U.S. Cl. ..... 418/55

[58] Field of Search ..... 418/55, 57

[56] References Cited

U.S. PATENT DOCUMENTS

| | | | |
|---|---|---|---|
| 801,182 | 10/1905 | Creux | 418/55 |
| 3,560,119 | 2/1971 | Busch et al. | 418/55 |
| 3,884,599 | 5/1975 | Young et al. | 418/55 |
| 3,924,977 | 12/1975 | McCullough | 418/55 |
| 4,065,279 | 12/1977 | McCullough | 418/55 |

FOREIGN PATENT DOCUMENTS

| | | | |
|---|---|---|---|
| 2160582 | 6/1973 | Fed. Rep. of Germany | 418/55 |

*Primary Examiner*—John J. Vrablik

*Attorney, Agent, or Firm*—Hopgood, Calimafde, Kalil, Blaustein & Judlowe

[57] ABSTRACT

A scroll-type compressor unit including fixed and orbiting scroll members contained within a cylindrical housing. Each scroll member has an end plate and a spiral element.

In order to reduce the radius of the cylindrical housing, the end plate of the orbiting scroll member is a circular plate having a radius of (a+R/2) at a minimum, and the center of the spiral element of the orbiting scroll member is offset from the center of the end plate by R/2 towards the terminal end of the spiral element, where the radius of the orbital motion of the orbiting scroll member is R, and the distance between the center and the terminal end of each spiral element is a. The fixed scroll member is disposed in the cylindrical housing so that the center of the cylindrical housing is offset from the center of the spiral element towards the terminal end of the spiral element thereof by R/2. In this arrangement, the inner radius of the cylindrical compressor housing is reduced to (a+3R/2) at a minimum.

8 Claims, 13 Drawing Figures

SCROLL-TYPE COMPRESSOR UNITS WITH MINIMUM HOUSING AND SCROLL PLATE RADII

BACKGROUND OF THE INVENTION

This invention relates to fluid displacement apparatus, and in particular, to fluid compressor units of the scroll type.

RELATED APPLICATION

This application discloses a scroll-type compressor of reduced diameter. In this application the scrolls and end plates are in constant contact with each other. The constant contact of the scrolls and end plates results in a compressor of high volumetric efficiency. In U.S. Ser. No. 070,929, filed Aug. 30, 1979, the radius of the compressor is reduced even further. However, its volumetric efficiency is not as high due to the fact that the scrolls and end plates are not in constant contact over their entire orbital path.

Scroll type apparatus has been well known in the prior art as disclosed in, for example, U.S. Pat. Nos. 801,182, 3,884,599, 3,924,977, 3,994,633, 3,994,635, and 3,994,636 each of, which includes two scroll members each having an end plate and a spiroidal or involute spiral element. These scroll members are maintained angularly and radially offset so that both of spiral elements interfit so as to maintain a plurality of line contacts between the spiral curved surfaces to thereby seal off and define at least one fluid pocket. The relative orbital motion of the scroll members shifts the line contacts along the spiral curved surfaces and, therefore, the fluid pocket changes in volume. The volume of the fluid pocket increases or decreases dependent on the direction of orbital motion. Therefore, the scroll-type apparatus is applicable to compress, expand or pump fluids.

In comparison with conventional compressors of the piston type, a scroll type compressor has advantages such as a lesser number of parts, continuous compression of fluid and others.

However, in order to increase the compressive capacitiy and compression ratio, the number of turns, or revolutions of each spiral element must be increased. This means that the diameter of the compressor unit is also increased.

SUMMARY OF THE INVENTION

It is an object of this invention to provide a scroll-type compressor unit in which the radius of the compressor housing and the weight of the unit are inherently reduced.

It is another object of this invention to provide a scroll-type compressor unit of a cylindrical shape with a relatively small diameter for the intended capacity which has a smooth operation in a wide range of operating condition.

It is another object of this invention to provide a scroll-type compressor unit which is simple in construction and production with the above described object being achieved.

In a compressor unit of the scroll type according to this invention, a first scroll member having first circular end plate means and first wrap means is fixedly disposed in a cylindrical compressor housing. A second scroll member having second circular end plate means and second wrap means which is similar to the first wrap means in the number of turns, pitch and thickness thereof is orbitably disposed in the compressor housing with the second wrap means interfitting with the first wrap means to provide a plurality of line contacts. The second scroll member is driven by driving means to effect orbital motion of a radius R to shift the line contacts.

The second end plate means is a circular plate having a radius of X which is expressed by $(a+R)>X\geqq(a+R/2)$, where a is a distance from the center of the second wrap means to the outer terminal end thereof. The center of the second wrap means is offset from the center of the second end plate means towards the outer terminal end of the second wrap means by R/2.

The first scroll member is disposed in the cylindrical housing so that the center of the cylindrical housing is offset from the center of the first wrap means towards the outer terminal end of the first wrap means by R/2.

The inner radius of the cylindrical housing can be less than $(a+2R)$, and $(a+3R/2)$ at a minimum.

Each of the first and second wrap means can be formed so as to terminate in a gradually reduced section by gradually reducing the increase of the outer radius of the wrap means. In this case, since the distance a is reduced, the radius of the cylindrical housing is further reduced.

Further objects and features of this invention will be understood from the following detailed description of preferred embodiments of this invention, with reference to the annexed drawings.

DETAILED DESCRIPTION OF PREFERRED EMBODIMENTS

Before describing specific embodiments of this invention, the principles of operation of scroll-type compressors will be described referring to FIGS. 1*a*–1*d* which show a pair of interfitting spiral elements 1 and 2, having similar revolution, pitch, and thickness.

Figure 1A:
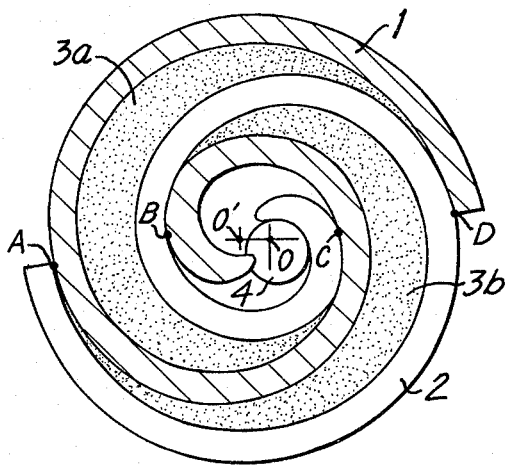
FIGS. 1*a*–1*d* are schematic views illustrating the principle of operation of a scroll-type compressor.

Referring to FIG. 1*a*, a orbiting spiral element 1 and the fixed spiral element 2 make line contacts as shown at four points A–D. Fluid pockets 3*a* and 3*b* are defined between line contacts D-C and line contacts A-B, as shown by the dotted regions. Fluid pockets 3*a* and 3*b* are defined not only by the walls of spiral elements 1 and 2 but also by the end plates onto which these spiral elements are affixed. These end plates are omitted in FIGS. 1*a*–1*d*.

Fluid pockets 3*a* and 3*b* move and reduce in volume as orbiting spiral element 1 effects orbital motion along a circle of a radius R which is the distance between the centers O and O′ of fixed and orbiting spiral elements 2 and 1. This will be understood from FIGS. 1*b*–1*d* which shows the configuration at orbital angular positions $\pi/2$, $\pi$, and $3\pi/2$ of orbiting spiral element 1.

Figure 1B:
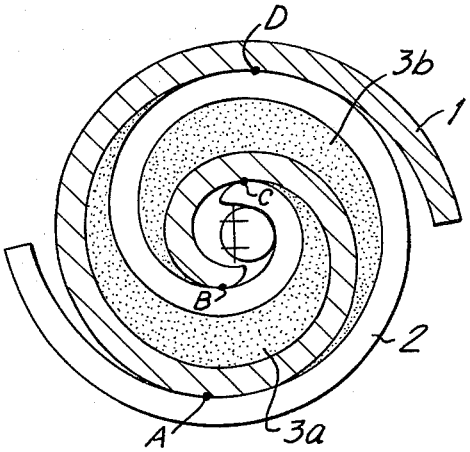
Figure 1C:
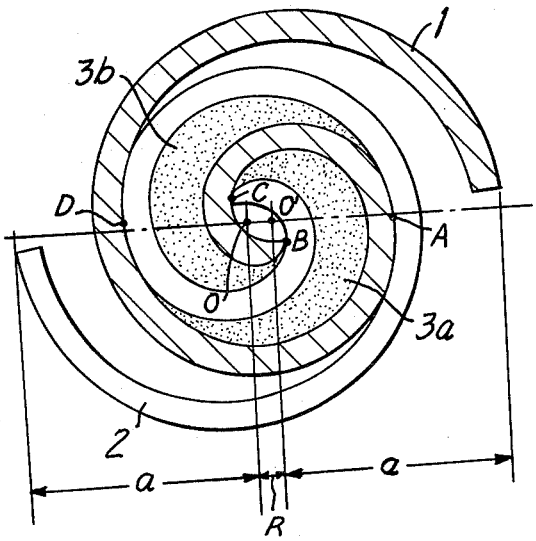
Figure 1D:
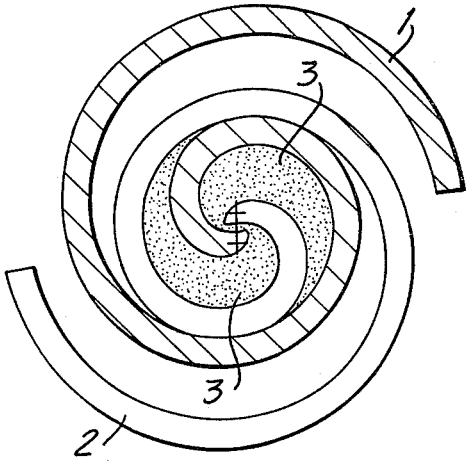

Fluid which is taken into fluid pockets 3*a* and 3*b* by the orbital motion of orbiting spiral element 1 from the configuration at FIG. 1*d* to the configuration shown in at FIG. 1*a*, is compressed by the further orbital motion of orbiting spiral element 1, and is discharged through a discharge port as shown at 4 in FIG. 1*a* which is formed in an end plate (not shown) of the fixed scroll member.

Because the fluid pockets are defined not only by the spiral elements but also the end plates onto which those spiral elements are affixed as described above. Because the end plate of orbiting scroll member 1 effects orbital motion of radius R, the inner radius of the compressor housing must be large enough to permit the end plate of orbiting scroll member 1 to effect orbital motion.

In known scroll type compressors, assuming that the radius of the orbital motion is R and that the distance from the center of each spiral element to the outer terminal end is a, as shown in FIG. 1*c*, the radius of the end plate of the orbiting scroll member is selected (a+R) at a minimum, so that the axial end of the fixed spiral element 2 always engages with the end plate of the orbiting scroll member. In this arrangement, the inner radius of the compressor housing must be (a+2R) or more, to permit the end plate of radius (a+R) to effect the orbital motion of radius R. The radius of the end plate of the fixed scroll member is selected (a+R) at a minimum.

However, in order to increase compression capacity without sacrificing smoothness of operation, and also to increase the internal compression ratio of the gas, it is normally required that the radius of the compressor unit or the number of turns of each spiral element be increased. Where the diameter of the compressor unit is limited due to design considerations, the maintenance of as high a capacity as possible, within the restricted diameter of the housing is essential.

It is therefore, a primary object of this invention to provide a scroll-type compressor unit wherein the radius of the compressor housing is reduced.

Figure 2:
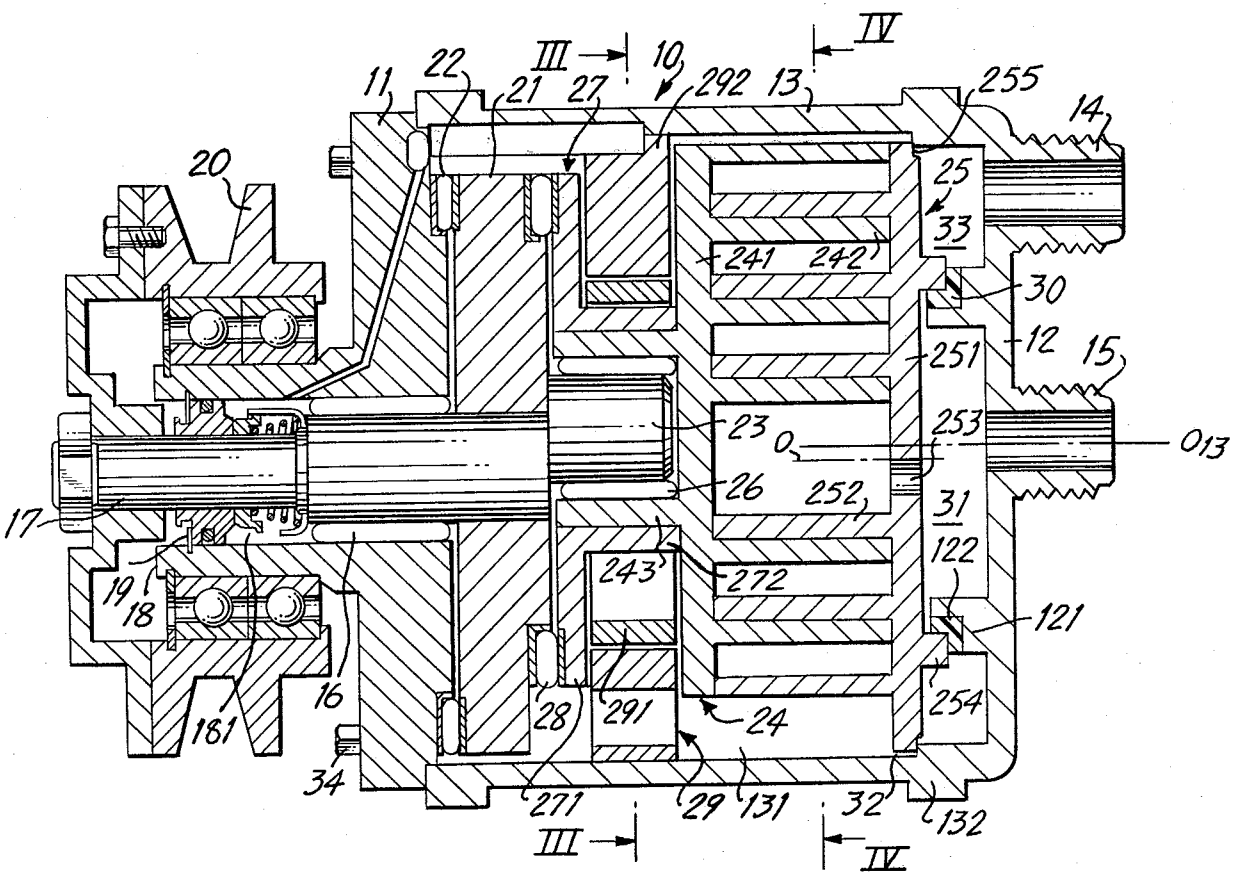
FIG. 2 is a vertical sectional view of a compressor unit of the scroll-type according to an embodiment of this invention.

Referring to FIG. 2, a refrigerant compressor unit 10 of the embodiment includes a compressor housing comprising a front end plate 11, a rear end plate 12 and a cylindrical body 13 connecting the end plates. Bear end plate 12 is shown integrally formed with cylindrical body 13 and is provided with a fluid inlet port 14 and a fluid outlet port 15 formed therewith. A drive shaft 17 is rotatably supported by a radial needle bearing 16 in front end plate 11. Front end plate 11 has a sleeve portion 18 projecting from the front surface thereof and surrounding drive shaft 17 to define a shaft seal cavity 181. Within shaft seal cavity 181, a shaft seal assembly 19 is assembled on drive shaft 17. A pulley 20 is rotatably mounted on sleeve portion 18 and is connected with drive shaft 17 to transmit an external power source (not shown) to drive shaft 17 through belt means (not shown) wound around pulley 20. A disk rotor 21 is fixedly mounted on an inner end of drive shaft 17 and is born on the inner surface of front end plate 11 through a thrust needle bearing 22 which is disposed concentrically with drive shaft 17. Disk rotor 21 is provided with a drive pin 23 projecting from the rear surface thereof. Drive pin 23 is radially offset from drive shaft 17 by a predetermined amount.

Reference numerals 24 and 25 represent a pair of interfitting orbiting and fixed scroll members. Orbiting scroll member 24 includes a circular end plate 241 and a wrap means or spiral element 242 affixed onto one surface of the end plate. End plate 241 is provided with a boss 243 projecting from the other end surface thereof. Drive pin 23 is fitted into boss 243 with a radial needle bearing 26 therebetween, so that orbiting scroll member 24 is rotatably supported on drive pin 23.

A hollow member 27 having a radial flange 271 is non-rotatably fitted onto boss 243 by means of a key and keyway connection. Radial flange 271 is supported on the rear end surface of disk rotor 21 by a thrust needle bearing 28 which is concentrically disposed with drive pin 23. The axial length of hollow member 27 is equal to, or longer than, the axial length of boss 243, so that the thrust load from orbiting scroll member 24 is supported on front end plate 11 through disk rotor 21. Therefore, the rotation of drive shaft 17 effects the orbital motion of orbiting scroll member 24 together with hollow member 27. Specifically, orbiting scroll member 24 moves along a circle of a radius equal to the length of the offset between drive shaft 17 and drive pin 23.

Means 29 for preventing orbiting scroll member 24 from rotating during orbital motion are disposed between end plate 241 of orbiting scroll member 24 and radial flange 271 of hollow member 27.

Figure 3:
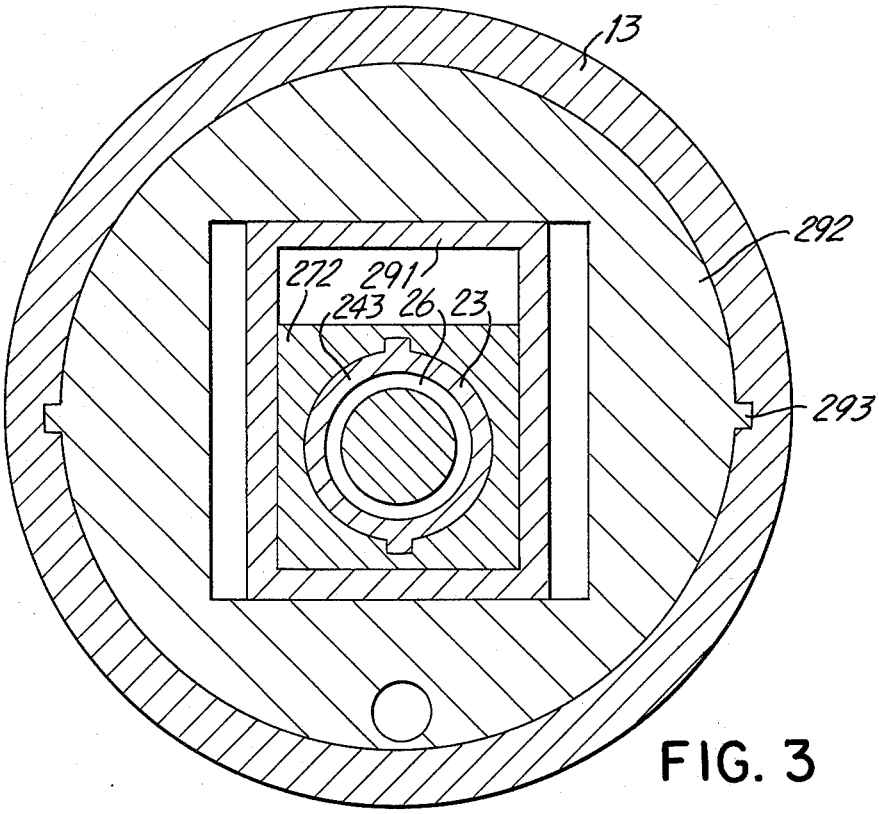
FIG. 3 is a sectional view taken along line III—III in FIG. 2.

Referring to FIG. 3 in addition to FIG. 2, hollow member 27 includes a cylindrical portion 272 having a rectangular outer contour, on which a rectangular slider member 291 is slidably fitted to permit motion in a radial direction. Rectangular slider member 291 has a rectangular hole with one pair of parallel sides equal to one pair of parallel sides of the outer rectangular periphery of cylindrical portion 272 and with the other pair of parallel sides longer than the outer pair of sides of rectangular cylindrical portion 272 by at least twice the offset length between drive shaft 27 and drive pin 23. Accordingly, slider member 291 is slidable on hollow member 27 in a radial direction along the longer parallel sides of the rectangular hole. Slider member 291 is also fitted into a ring like member 292 which is non-rotatably fixed to the inner surface of cylindrical body 13 of the compressor housing by a key and keyway connection (shown at 293 in FIG. 3). The central hole of ring like member 292 is a rectangular hole with one pair of parallel sides equal in length to one pair of parallel sides of the outer rectangle of slider member 291 and with the other pair of parallel sides longer than the other parallel sides of the same outer rectangle by at least twice the offset length between drive shaft 17 and drive pin 23, so that the slider member 291 is slidable within ring like member 292 in a radial direction perpendicular to the sliding direction of same on hollow member 27.

Accordingly, hollow member 27 is permitted to move in two radial directions perpendicular to one another and, therefore, moves along a circle as a result of the movement in the two radial directions, but is prevented from rotation. Therefore, the eccentric movement of drive pin 23 by the rotation of drive shaft 17 effects the orbital motion of orbiting scroll member 24 together with hollow member 27 without rotation.

In another construction of ring like member 292, it has a central hole permitting the hollow member to axially pass therethrough and is formed with a depression in an end surface for receiving and slidably guiding slider member 291. This construction permits the ring like member to be thin.

Fixed scroll member 25 also comprises a circular end plate 251 and a wrap means or spiral element 252 affixed onto one surface of the end plate. The end plate 251 is provided with a hole or a discharge port 253 formed at a position corresponding to the center line of the spiral elements, and with an annular projection 254 on the rear end surface around discharge port 253.

Rear end plate 12 is provided with an annular projection 121 on the inner surface thereof around outlet port 15. The outer radius of annular projection 121 is slightly shorter than the inner radius of annular projection 254. Annular projection 121 is cut away along the outer edge of the projecting end to define an annular recess 122. An annular elastic material, for example, a rubber ring 30 is fitted into annular recess 122 and is compressed between interfitted annular projections 121 and 254, so that fixed scroll member 25 is elastically supported on annular projection 121 of rear end plate 12. Rubber ring 30 serves as a seal to seal off a chamber 31 defined by annular projections 121 and 254 from the interior space 131 of the compressor housing. Chamber 31 connects between outlet port 15 and discharge port 253 of fixed scroll member 25.

End plate 251 of fixed scroll member 25 is formed with a plurality of cut away portions 255 at the rear peripheral edge. A plurality of projections 132 are formed on the inner surface of cylindrical body 13 of the compressor housing and are mated into cut away portions 255, so that fixed scroll member 25 is non-rotatably disposed within the compressor housing. Gaps 32 are maintained between the inner wall of cylindrical body 13 and the peripheral end of fixed scroll member 25, and, therefore, a chamber portion 33 surrounding annular projections 121 and 254 does not form a sealed off chamber within interior space 131 of the compressor housing. Chamber portion 33 communicates with inlet port 14.

In operation, when drive shaft 17 is rotated by an external power source (not shown) through pulley 20, drive pin 23 moves eccentrically to effect orbital motion of orbiting scroll member 24. The rotation of orbiting scroll member 24 is prevented by rotation preventing means 29. The orbital motion of orbiting scroll member 24 compresses the fluid introduced in interior space 131 through inlet port 14, chamber portion 33, and gaps 32. The compressed gas is discharged from outlet port 15 through discharge port 253 and chamber 31.

In the arrangement as described above, since fixed scroll member 25 is axially urged toward orbiting scroll member 24 by the restoring force of compressed rubber ring 30, sealing between end plate 241 of orbiting scroll member 24 and the axial end of fixed spiral element 252, as well as between end plate 251 of fixed scroll member 25 and the axial end of orbiting spiral element 242 is secured. The sealing is reinforced by a fluid pressure discharged into chamber 31. The axial load for securing the seal is supported on disk rotor 21 through orbiting scroll member 24, hollow member 27 having radial flange 271, and thrust bearing 28. The axial load is further supported through disk rotor 21 and thrust bearing 22 on front end plate 11, which is secured onto the front end of cylindrical body 13 of the compressor housing. Therefore, any deflection of the moving parts is prevented during operation of the compressor, so that vibration of the compressor and abnormal wear on individual parts may be prevented. Since disk rotor 21, fixedly mounted on drive shaft 17 is supported through thrust bearing 22 on front end plate 11, drive shaft 17 is securely and non-vibratingly supported by the use of a single needle bearing as a radial bearing.

The radial sealing force at each line of contact between fixed and orbiting spiral elements 252 and 242 is determined by the radius of the orbital motion of orbiting scroll member 24 or the offset length between drive shaft 17 and drive pin 23, and the pitch and thickness of each of fixed and orbiting spiral elements 252 and 242. In practical use, the distance between drive shaft 17 and drive pin 23 is preferably selected slightly larger than half of the dimensional difference between the pitch of each spiral element and the total thickness of the fixed and orbiting spiral elements. This arrangement is permitted by the fact that fixed scroll member 25 is moveably radially supported by compressed rubber ring 30. A sufficient radial seal is established, even during initial use of the compressor after assembly. The radial seal is completed when the contact surfaces of both spiral elements wear during use, to fit one another.

In the arrangement of the compressor as described above the assembly operation of the compressor is very simple; annular elastic material 30, fixed and orbiting scroll members 25 and 24, rotation preventing means 29, hollow member 27, bearings 26 and 28, and a pre-assembly of drive pin 23, disk rotor 21, bearings 16 and 22, drive shaft 17 and front end plate 11, are inserted in this order into cylindrical body 13 having rear end plate 12, and the compressor is completed by securing front end plate 11 onto the cylindrical body 13 by bolt means 34.

Figure 4:
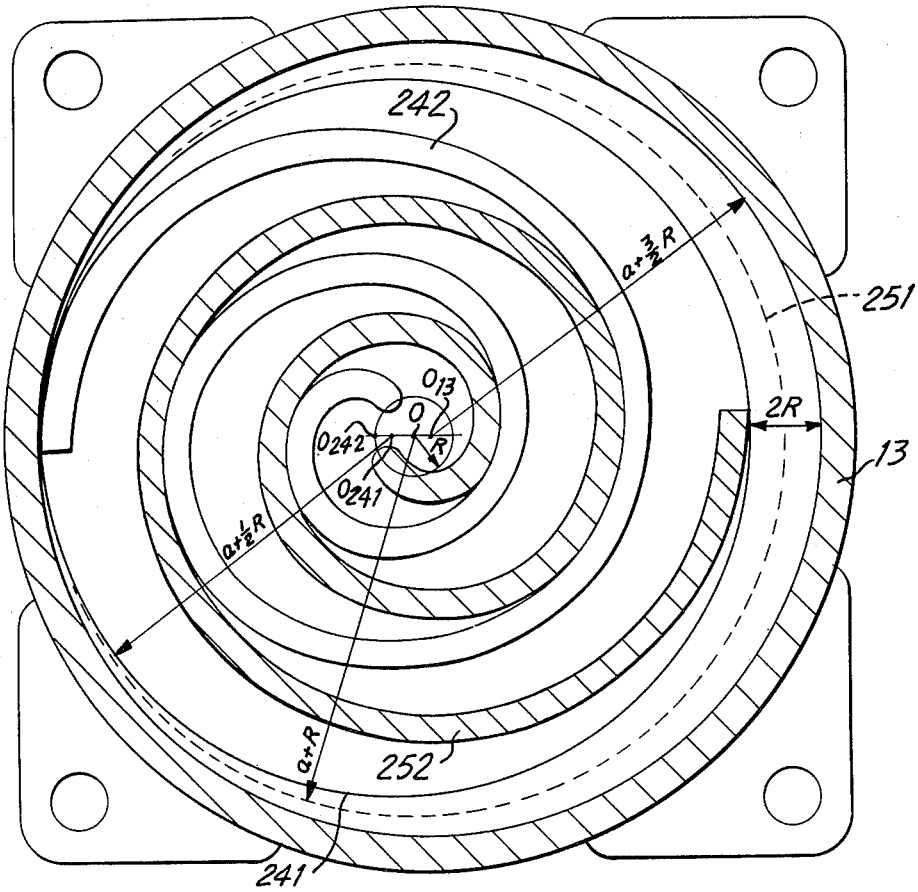
FIG. 4 is a sectional view taken along line IV—IV in FIG. 2.

Referring to FIG. 4, the end plate 241 of orbiting scroll member 24 is a circular plate of a radius of $(a+R/2)$, and the center $O_{242}$ of orbiting spiral element 242 is offset from the center $O_{241}$ of orbiting end plate 241 towards the outer terminal end of orbiting spiral element 242 by $R/2$, where a is the distance from a center of each of the spiral elements to the outer terminal end of the spiral element, and R is the radius of the orbital motion of the orbiting scroll member. While the center $O_{13}$ of compressor housing 13 is also offset from the center O of fixed spiral element 252 by $R/2$ towards the outer terminal end of the fixed spiral element. This enables a reduction of the inner radius of the compressor housing to $(a+3R/2)$ at a minimum.

Figure 5:
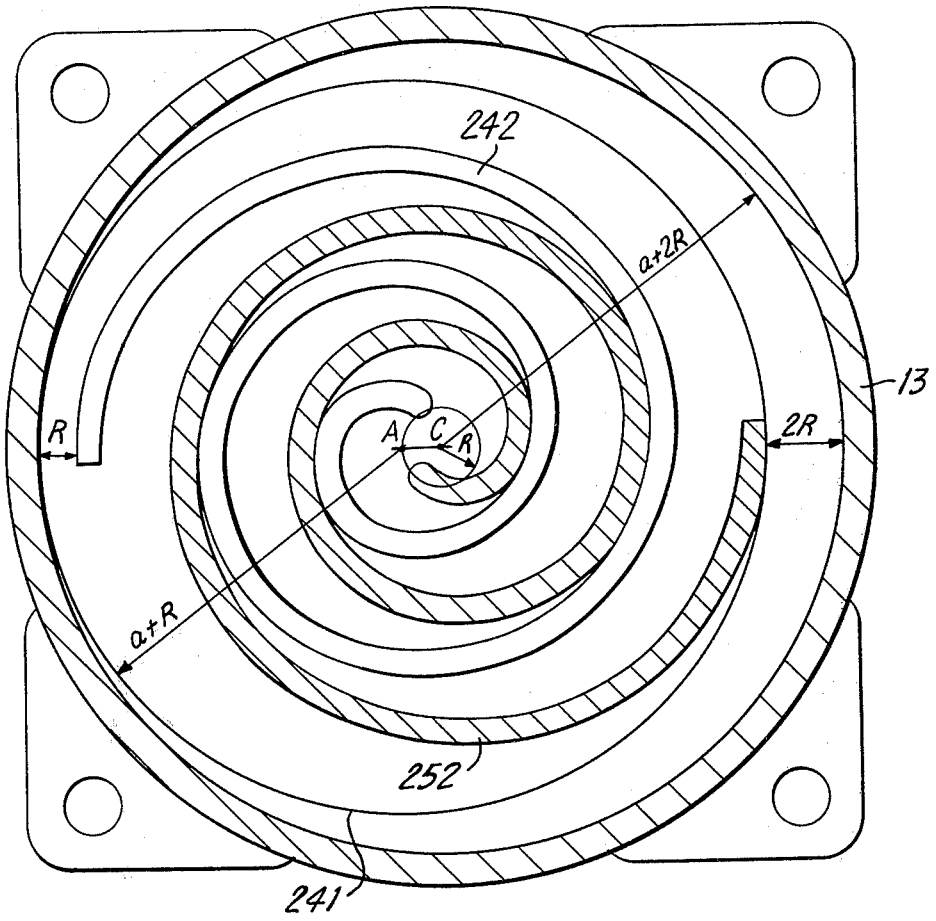
FIG. 5 PRIOR ART
FIG. 5 is a view similar to FIG. 4 of a known compressor of a scroll type.

Referring to FIG. 5, since the center $O_{242}$ of orbiting spiral element 242 is concentrict with the center $O_{241}$ of orbiting end plate 241 and since center $O_{13}$ of compressor housing 13 is concentric with center O of fixed spiral element 252 in a conventional scroll-type compressor, the radius of each one of end plates 241 and 251 has been selected $(a+R)$ or more to insure constant contact between the spiral element of each scroll members and the end plate of the other scroll member. Therefore, the inner radius of compressor housing 13 must be $(a+R+R)=(a+2R)$ or more to permit end plate 241 having a radius $(a+R)$ to effect orbital motion within the compressor housing.

It will be noted from the above description that the diameter of the compressor housing according to the above described embodiment is reduced by R in comparison with the conventional scroll-type compressor.

Referring to FIG. 4, the radius of fixed end plate 251 is selected from (a+R/2) to (a+3R/2). When the radius is selected (a+R/2), the center of fixed end plate 251 is offset from center O of fixed spiral element 252 by R/2 in a direction opposite to the terminal end of spiral element 252. Specially, in the state as shown in FIG. 4, the center of fixed end plate 251 is disposed on center $O_{241}$ of orbiting end plate 241.

As the radius is increased, the center is displaced towards center O of fixed spiral element 252 by the increased length. When the radius is selected (a+R), the center of fixed end plate 251 is disposed concentrically with center O of fixed spiral element 252. The fixed end plate having a radius of (a+R) is shown in FIG. 4 by a dotted line.

In a further increase of the radius, the center of the fixed end plate is displaced towards the terminal end of fixed spiral element 252. When the radius is selected (a+3R/2), the center of the fixed end plate is offset from center O of fixed spiral element 252 by R/2 towards the outer terminal end of fixed spiral element 252, that is, concentric with center $O_{13}$ of the compressor housing. Since the radius (a+3R/2) of fixed end plate 251 is equal to the inner radius of compressor housing 13, a fixed end plate having a further increase in radius is not used.

In the arrangement of the above described embodiment, it will be understood that the spiral element of each scroll member 24 and 25 always contact the end plate of the other scroll member, during the orbital motion of the orbiting scroll member. Referring to FIG. 4, it is clearly noted that contact between the end plate of each of the scroll members and the entire axial end surface of the spiral element of the other scroll member is insured at the condition where the outer terminal ends of both spiral elements are away from each another by the greatest distance, which corresponds to the condition shown in FIG. 1*c*. Therefore, even if orbiting end plate 241 and orbiting spiral element 242 effects orbital motion of a radius R, as shown in FIGS. 1*d*, 1*a*, and 1*b*, the spiral element of each scroll member always contacts the end plate of the other scroll member.

Figure 6A:
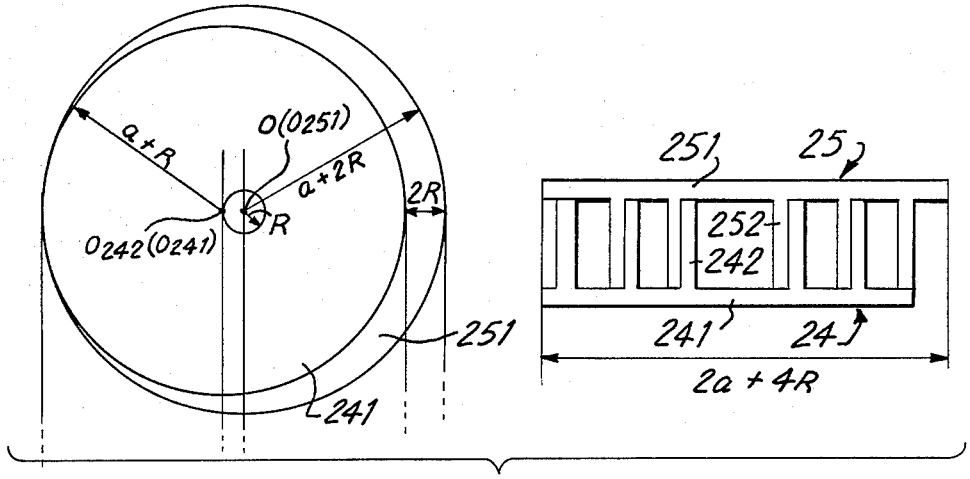
FIG. 6a PRIOR ART
FIG. 6*a* is a view illustrating the dimensional relations of the scroll members in a known compressor.
Figure 6B:
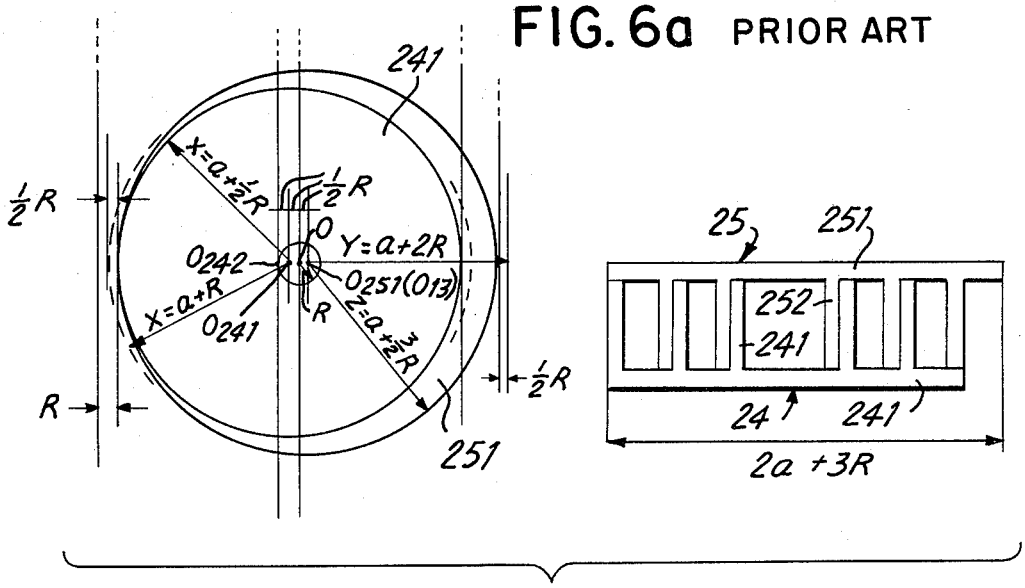
FIG. 6*b* is a view illustrating the dimensional relations of scroll members according to the present invention.

Referring to FIGS. 6*a* and 6*b*, it will be noted that the inner diameter of the compressor housing of the embodiment of the present invention is reduced by R in comparison with the conventional scroll-type compressor, as previously described. In the figures, the fixed end plate of fixed scroll member 25 is shown to have a diameter equal to the inner diameter of the compressor housing.

It will be understood from FIG. 6*b* that the radius of orbiting end plate 241 can be selected more than (a+R/2) but less than (a+R) according to the present invention. That is, since the inner radius Y of the compressor housing is required to be (X+R) at a minimum, assuming that the radius of fixed end plate 241 is X, the radius Y is maintained shorter than the minimum inner radius (a+2R) of the compressor housing of the conventional compressor, if radius X is shorter than (a+R).

Accordingly, by displacing center $O_{242}$ of orbiting spiral element 242 from center $O_{241}$ of orbiting end plate 241 by R/2 towards the outer terminal end of the orbiting spiral element, and by displacing center $O_{13}$ of compressor housing 13 from center O of fixed spiral element 252 by R/2 towards the outer terminal end of the fixed spiral element, the radius Y of the compressor housing can be reduced in comparison with a conventional compressor of the scroll type. Radius Y may be: $(a+2R)>Y\geqq(a+3/2R)$, if radius X of the orbiting end plate is selected $(a+R)>X\geqq(a+\frac{1}{2}R)$. Since the inner radius Y cannot be shorter than (X+R) to insure orbital motion of the orbiting scroll member, $Y\geqq(X+R)$.

As described above, the radius Z of fixed end plate 251 can be selected: $(a+R/2)\leqq Z\leqq(a+3R/2)$ when inner radius Y is (a+3R/2), controlling the position of the center of fixed end plate 251 in relation to the center of the fixed spiral element as described above. However, since inner radius Y of the compressor housing is increased, radius Z of fixed end plate 251 can be increased.

Referring to FIG. 6*b*, when center $O_{251}$ of fixed end plate 251 is displaced to a point offset from center O of fixed spiral element 252 leftwards by L: $(0\leqq L\leqq R/2)$, the radius Z of fixed end plate must be selected $(a+R/2)+(R/2-L)=(a+R-L)$ at a minimum, as will be understood from the above description regarding the fixed end plate in reference to FIG. 4. On the other hand, when center $O_{251}$ is displaced to a point offset from center O of fixed spiral element 252 rightwards by L $(0\leqq L\leqq R/2)$, the required radius Z of the fixed end plate is (a+R+L) at a minimum.

If the inner radius Y of the compressor housing is increased by ΔY from the minimum value (a+3R/2), or $Y=a+3R/2+\Delta Y$, the radius Z can be increased by ΔY. Therefore, when center $O_{251}$ is offset from center O leftwards by L as above described, the maximum radius Z is:

$$\begin{aligned} Z &= (a + R - L) + \Delta Y \\ &= a + 3R/2 - R/2 + \Delta Y \\ &= Y - R/2 - L \end{aligned}$$

On the other hand, when center $O_{251}$ is offset from center O rightwards by L as described above, the maximum radius Z is:

$$\begin{aligned} Z &= (a + R + L) + \Delta Y \\ &= a + 3R/2 - R/2 + L + \Delta Y \\ &= Y - R/2 + L \end{aligned}$$

As described above, inner radius Y of the compressor housing is reduced to (a+3R/2) at a minimum by the use of the orbiting circular end plate of radius (a+R/2) according to this invention.

Figure 7:
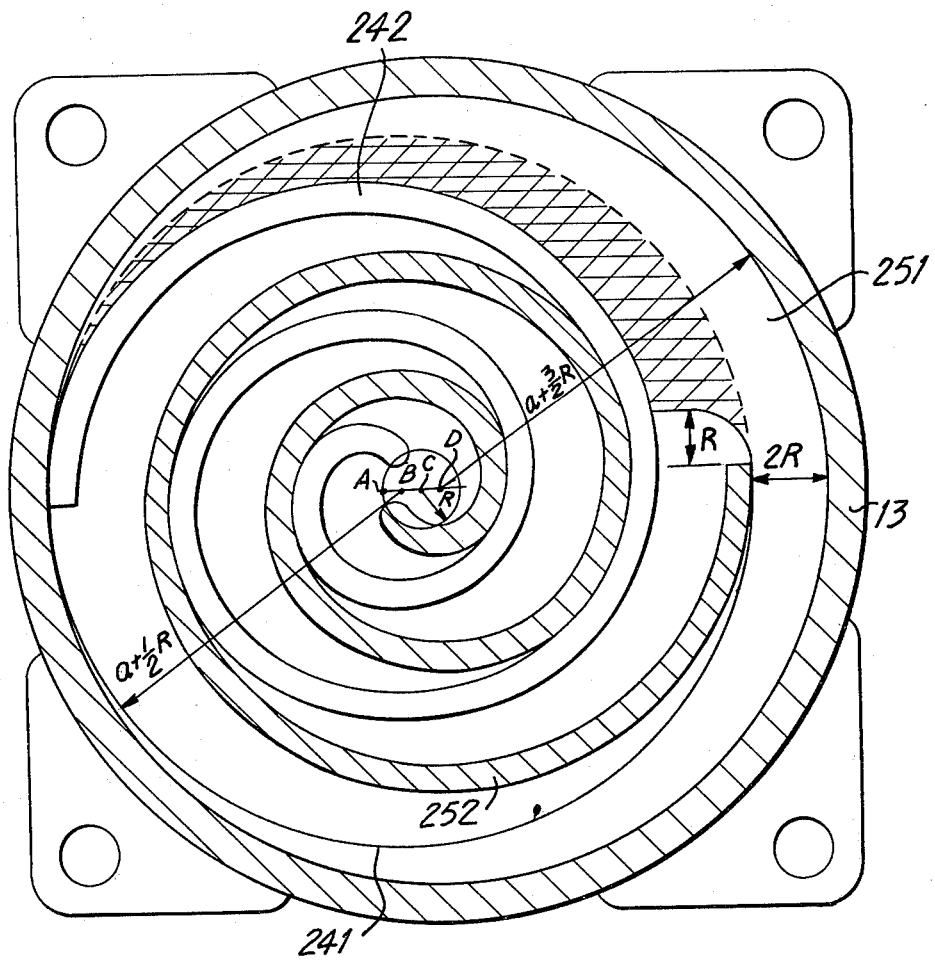
FIG. 7 shows a view similar to FIG. 4 of another embodiment.

However, orbiting end plate 241 can be cut away at the peripheral edge over an angular extent of 180° along the outermost curved surface of spiral element 242, insuring constant contact between orbiting end plate 241 and the entire axial end surface of fixed spiral element 252. The cut away portion is shown as a cross-hatched portion in FIG. 7. The cut away portion does not extend over the entire 180° angular extent, but rather a portion extending a length R from an angular position shifted 180° from the terminal end of the orbiting spiral element remains uncut. This is done in order to assure constant contact between orbiting end plate 241 and the terminal end of fixed spiral element 252 during the orbital motion of the orbiting scroll member.

Figure 8:
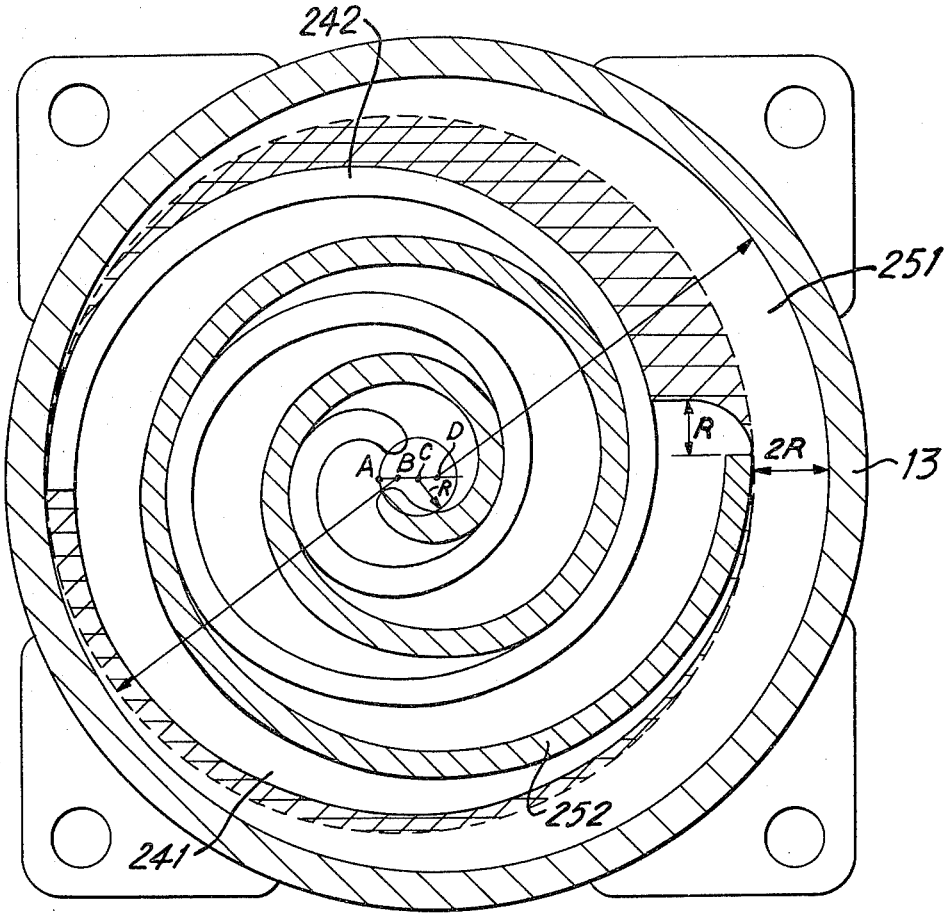
FIG. 8 shows a view similar to FIG. 4 of a further embodiment.

Orbiting end plate 241 can be further cut away at its peripheral edge over the other 180° angular extent, along an imaginary spiral curve extending from the outer terminal end of the inner curved surface of orbiting spiral element 242, as shown in FIG. 8. The cut away portions are shown as two cross-hatched sections.

Since each spiral element has a dimension of thickness, constant contact between the orbiting end plate and the entire axial surface of the fixed spiral element is still assured.

Fixed end plate 251 can be also cut away at the peripheral edge similar to orbiting end plate 241. This will be easily understood without description, because orbiting scroll member 24 and fixed scroll member 25 are in a relationship such that one is angularly offset 180° from the other. That is, fixed end plate 251 can be shaped similar to orbiting end plate 241 in FIG. 7 or 8 which is angularly shifted 180°.

Figure 9:
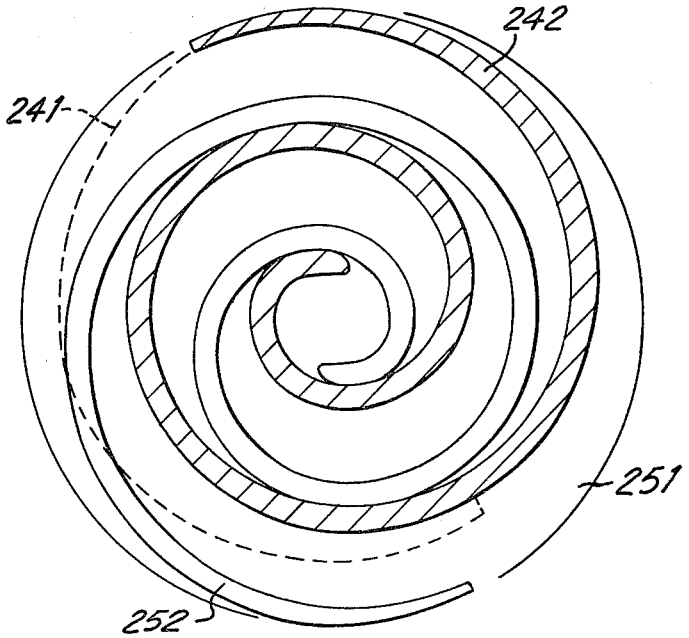
FIG. 9 is a schematic view of interfitting fixed and orbiting spiral elements according to a further embodiment of this invention.

Referring to FIG. 9, fixed and orbiting spiral elements 252 and 242 can terminate in gradually reduced sections 242*a* and 252*a*. That is, the increase in radius of the section is reduced. For example, the radius can be constant and, then, the outer curved surface of the section is an arc of a circle of radius a. Thus, the distance a from the center of each spiral element to the outer terminal end of it can be reduced. Therefore, the radius of the compressor housing is also reduced. Furthermore, since each spiral element is reduced at its terminal end in thickness, the end portion has flexibility so that the mechanical shock by the collision of the terminal end of each spiral element with the other spiral element may be damped.

In the embodiment shown in FIG. 2, since the center axis of drive pin 23 is concentric with the center of orbiting spiral element 242, the center axis of drive shaft 17 is consisted with center O of fixed spiral element 252 and, therefore, is offset from center axis O is of the compressor housing by R/2. However, since it is sufficient to the operation of the device that the central axes of drive pin 23 and drive shaft 17 are concentric with an two imaginary points due to the parallel movement of centers $O_{242}$ and O of interfitting orbiting and fixed spiral elements 242 and 252, drive shaft 17 can be disposed so that the central axis thereof is concentric with the central axis of the compressor housing.

This invention has been described in detail in connection with preferred embodiments, but these embodiment are for example only and this invention is not restricted thereto. It will be easily understood by those skilled in the art that other variations and modifications can easily be made within the scope of this invention.

What is claimed is:

1. In a scroll-type fluid compressor unit having a cylindrical compressor housing including a front end plate and a rear end plate, a fixed scroll member fixedly disposed within said compressor housing including first circular end plate means to which first wrap means are affixed, an orbiting scroll member orbitably disposed within said compressor housing including second circular end plate means to which second wrap means are affixed, said second wrap means being similar to said first wrap means in number of turns, pitch and thickness, driving means for effecting orbital motion of said orbiting member, and said first and second wrap means interfitting with an angular phase difference of 180° to make a plurality of line contacts to define at least one pair of sealed off fluid pockets which move with a reduction of volume thereof by the orbital motion of said orbiting scroll member, to thereby compress the fluid in said pockets, the improvement which comprises said second circular end plate means having a radius of X which is expressed by $(a+R)>X\geqq(a+R/2)$, where a is the distance from the center of said second wrap means to the outer terminal end, and R is the radius of said orbital motion, said second wrap means being affixed to said second circular end plate means in a manner so that the center of said second wrap means is offset from the center of said second end plate means towards the outer terminal end of said second wrap means by R/2, said fixed scroll member being fixedly disposed within said compressor housing in a manner so that the center axis of said cylindrical compressor housing is offset from the center of said first wrap means towards the outer terminal end of said first wrap means by R/2, said cylindrical compressor housing having a radius of Y which is expressed by $(a+2R)>Y\geqq(X+R)$, and said first end plate means having a size sufficient to at all times contact the entire axial surface of said second wrap means during the orbital motion of said second orbiting scroll member.

2. The improvement as claimed in claim 1, wherein said first end plate means has a radius of Z which is expressed by $(Y-R/2+L)\geqq Z\geqq(a+R+L)$, where $0\leqq L\leqq R/2$, and said first wrap means being affixed to said first circular end plate means in such manner that the center of said first end plate means is offset from the center of said first wrap means by L towards the outer terminal end of said first wrap means.

3. The improvement as claimed in claim 1, wherein said first end plate means has a radius of Z which is expressed by $(Y-R/2-L)\geqq Z\geqq(a+R/2+L)$, where $0<L\leqq R/2$, and said first wrap means being affixed to said first circular end plate means in such manner that the center of said first wrap means is offset from the center of said first end plate means by L towards the outer terminal end of said first wrap means.

4. The improvement as claimed in claim 1, wherein said second end plate means is a generally circular plate having a radius of (a+R/2) and said second end plate means being cut away at the peripheral edge thereof over an angular extent of approximately 180° along the outermost curved surface of said second wrap means but a portion of said edge remaining to contact the outer terminal end of said first wrap means.

5. The improvement as claimed in claim 4, wherein said second end plate means is further cut away at the peripheral edge thereof over the other 180° angular extent along a spiral curve extending 180° from the outer terminal end of the inner curved surface of said second wrap means.

6. The improvement as claimed in claim 1, wherein said first end plate means is a generally circular plate having a radius of (a+R/2) and said first end plate means being cut away at the peripheral edge thereof over an angular extent of approximately 180° along the outermost curved surface of said first wrap means but a portion of said edge remaining to contact the outer terminal end of said second wrap means.

7. The improvement as claimed in claim 6, wherein said first end plate means is further cut away at the peripheral edge thereof over the other 180° angular extent along a spiral curve extending 180° from the outer terminal end of the inner curved surface of said first wrap means.

8. The improvement as claimed in claim 1, which further comprises each of said first and second wrap means terminating in a gradually reduced section, with the increase of the outer radius of said section is gradually reduced in comparison with that of the inner radius thereof.

* * * * *